United States Patent [19]

Christmann

[11] 4,077,124

[45] Mar. 7, 1978

[54] PAPER HANGING TRIMMING TOOL

[76] Inventor: Norbert Christmann, Burlington, Canada

[21] Appl. No.: 745,818

[22] Filed: Nov. 29, 1976

[51] Int. Cl.[2] ..... B26B 29/00

[52] U.S. Cl. ..... 30/287; 30/292; 30/293; 30/294

[58] Field of Search ..... 30/287, 292, 294, 293, 30/289, 286

[56] References Cited

U.S. PATENT DOCUMENTS

| | | | |
|---|---|---|---|
| 636,468 | 11/1899 | Strang | 30/292 |
| 1,790,014 | 1/1931 | Mikitta | 30/287 |
| 1,813,868 | 7/1931 | Smiroldo | 30/294 |
| 1,843,535 | 2/1932 | Arnold | 30/287 X |
| 2,187,590 | 1/1940 | Lurie | 30/294 X |
| 2,677,180 | 5/1954 | Schierghofer | 30/292 |
| 2,679,100 | 5/1954 | Ehler | 30/294 X |
| 2,743,523 | 5/1956 | Honey | 30/294 X |
| 2,853,778 | 9/1958 | Pratt et al. | 30/294 |
| 3,457,643 | 7/1969 | Hill | 30/294 X |
| 3,889,368 | 6/1975 | Himeno | 30/294 X |

FOREIGN PATENT DOCUMENTS

| | | | |
|---|---|---|---|
| 129,739 | 10/1950 | Sweden | 30/293 |

*Primary Examiner*—Gary L. Smith
*Assistant Examiner*—J. T. Zatarga
*Attorney, Agent, or Firm*—Hirons & Rogers

[57] ABSTRACT

A handtool for the application of sheet materials to surfaces, specifically the application of wall coverings to walls, is of obtuse angle triangle shape, with a knife blade at each base apex, the tip apex being rounded for folding the sheet into a corner and the edges adjacent the tip constituting guides for the respective knife blades. One blade may be circular and rotary with the guide edge tangential thereto, while the other blade is triangular with the guide edge colinear with the cutting edge. The circular blade may be toothed with a recessed cutting edge, while the triangular blade may be equilateral to provide six cutting edges by transposition and reversal. Two similar guides are provided on opposite sides of the body slidable in guideways between a retracted position and extended positions in which they lie alongside the knives to guide their cutting with respect to a surface engaged by the guide.

7 Claims, 4 Drawing Figures

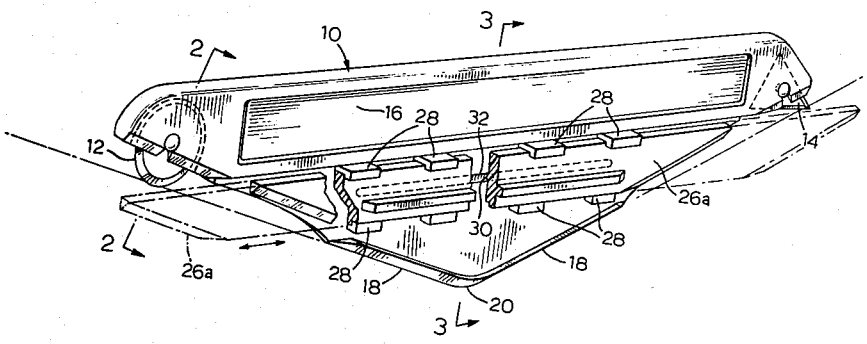

PAPER HANGING TRIMMING TOOL

FIELD OF THE INVENTION

The present invention is concerned with improvements in or relating to handtools for cutting sheet materials and especially, but not exclusively, to such tools for folding and/or cutting paper or plastic wall coverings.

REVIEW OF THE PRIOR ART

The neat and fast handling of sheet materials is a continuing problem, especially sheet materials such as paper and plastic wall coverings that can only be manipulated by hand, often under difficult circumstances. It is a common practice to use a straight-edged knife or razor blade for this purpose, but it is found with wet paper that it will often tear instead of cutting, while plastic materials will cut unevenly, and repeated cuts at the same place will not register with one another. A similar problem arises when cutting above baseboards, around window casings, door casings and cupboards. Moreover, the plastering of a room is almost never completely even and the resulting airgaps behind the covering will often result in an uneven cut or tear at their location.

The cutting of wall coverings around deep wall openings such as walk throughs or frameless doors presents its own problems, and the conventional use of scissors, straight knife blades etc., produces in any but skilled hands, an uneven edge which either extends beyond the corner, or is recessed from it to expose the underlying wall. Numerous attempts have been made therefore to produce a handtool that will permit a relatively unskilled operator to apply wall coverings neatly and quickly, and as examples of such prior attempts may be mentioned those disclosed in U.S. Pat. Nos. 1,108,161; 1,574,641; 1,825,108; 1,863,153; 2,120,960; 2,677,180; 2,770,879; 2,853,778 and 3,395,453.

DEFINITION OF THE INVENTION

It is the object of the invention to provide a new handtool for the neat and rapid folding and/or cutting of wall coverings during their application, even by relatively unskilled operators.

In accordance with the present invention there is provided a handtool for the application of sheet materials to surfaces comprising:

- a thin body of obtuse, angle triangle shape in side elevation, having an obtuse-angled tip apex opposite to a base side thereof, and having respective base apices opposite to its other two sides, the body being adapted to be grasped adjacent its base side by the hand of an operator;
- the tip apex of the body being rounded for folding engagement thereof with the sheet material;
- a first circular knife blade rotatably mounted at one of the base apexes with its circular cutting edge aligned with the adjacent other side;
- and a second straight-edge knife blade mounted at the other base apex with its straight cutting edge aligned with the adjacent other side;
- each of said two other body sides having a straight portion thereof cooperating with the respective knife blade, whereby with the said body side straight portion in contact with the sheet material the respective knife blade cutting edge cuts into the sheet material and is guided by the straight portion in a cut coextensive therewith as the handtool is moved by the operator over the sheet material.

DESCRIPTION OF THE DRAWINGS

A handtool intended for the neat and rapid application of wall coverings to walls, and comprising a particular preferred embodiment of the invention will now be described, by way of example, with reference to the accompanying diagrammatic drawings, wherein.

DESCRIPTION OF THE PREFERRED EMBODIMENTS

Figure 1:
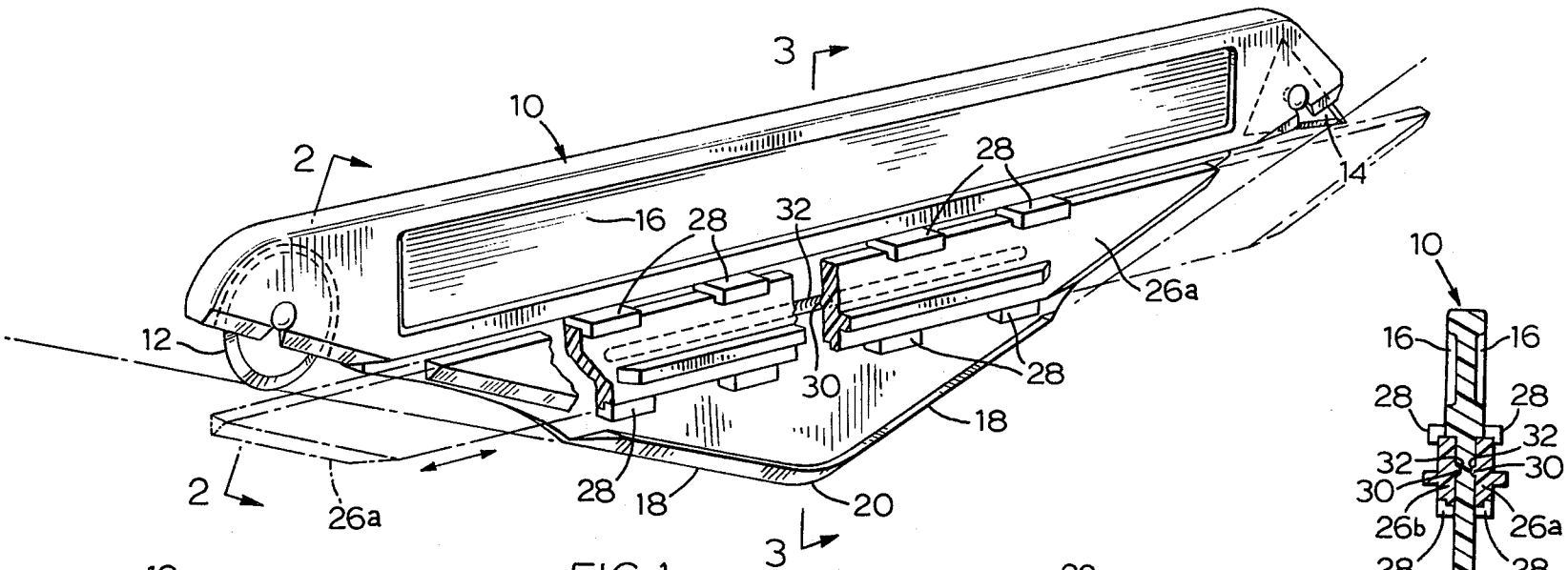
FIG. 1 is a perspective view of the device.
Figure 3:
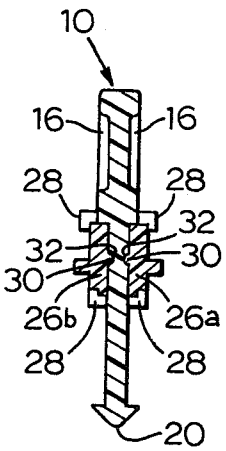
FIGS. 2 and 3 are respective sections taken on the lines 2:2 and 3:3 of FIG. 1.

In the usual procedure for the application of a wall covering the rear surface of an over-length sheet is coated with paste, or if pre-pasted it is dipped into water, and the damp sheet is then sponged onto the wall. The sheet is then cut accurately to length at the top and bottom without the need for prior markings using my new handtool, the tool simultaneously folding the paper into any top and bottom corners that are present, e.g., between the wall and the baseboard. If the sheet is to cover an inside corner the tool is used to press the sheet into the corner with the elimination of air bubbles, while when it extends over an open doorway, etc., the tool is used for accurate trimming of the sheet around the opening.

The illustrated version of the tool comprises a thin flat body indicated generally by the reference 10, of a size to fit comfortably in a hand of average size. As will be seen from FIG. 1, the shape in side elevation is that of an obtuse-angled equilateral triangle with a rounded tip apex. Alternatively, it may be described as a downwardly-tapered skeg symmetrical about a centre line that passes through the skeg tip. A circular shape knife blade 12 is rotatably mounted in a corresponding recess at one base apex of the triangular body, while a triangular shape blade 14 is removably fixed in another recess at the other base apex. The shape of this latter recess corresponds to the blade shape, so that the blade is held in fixed position. The portion of the body extending between the two blades parallel to the base side, is provided with opposed finger-gripping recesses 16 formed in the side walls of the body.

The portions 18 of the two edges that meet at the rounded body tip apex 20 are themselves straight and of rounded triangular cross-section. The rounded tip portion provides a shaped edge for pressing the wall covering into a corner, while each straight edge portion provides a respective guide edge for guiding the path of its aligned associated knife blade in a straight accurate cutting line coextensive therewith. To this end a geometric projection of the edge portion 18 which guides the rotary knife 12, as indicated by a broken line, is tangential to its cutting edge, while a projection of the other edge portion 18 intersects the tip of the triangular knife 14, both blades projecting beyond their respective projection to take account of the thickness of the material to be cut so that the blades will cut into the material while the respective cooperating edge portions 18 are in contact with the material.

A rotary cutter is much more effective than a fixed cutter in severing damp and flimsy sheet materials, but cannot cut into corners, and would leave a recessed uncut start that may tear. The triangular cutter is first used therefore, to start a cut into such a corner, and thereafter the rotary cutter can be used. The movement of the tool will simultaneously prefold the paper firmly into the corner just before it is cut, displacing away air pockets that might otherwise form. The stability of cut provided by the respective guide portions 18 ensures that repeat cuts can be made with expectation that the cuts will superimpose. A folding operation without cutting is of course possible by manipulating the tool without either knife contacting the sheet.

Figure 4:
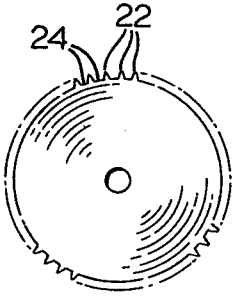
FIG. 4 is a side elevation of a specific form of rotary knife for use with the tool.
Figure 2:
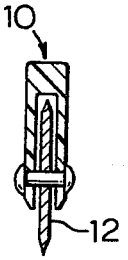

A smooth-edged circular knife 14 is illustrated in FIG. 1, but this may be replaced by the toothed or serrated knife illustrated by FIG. 4, the teeth 22 extending from a "recessed" smooth circular cutting edge 24 of smaller diameter. Thus, the teeth prick into the sheet to start the cut and there is less tendency to tear. Moreover, it is the teeth that will be dulled and blunted by the inevitable contact with the wall behind the sheet, while the recessed circular edge cannot so easily contact the wall and will remain sharp longer. It can be seen that the triangular knife 14 is preferably equilateral and provides six possible cutting edges, two at each apex, by rotating and reversing the blade in its recess between its different possible fixed positions, so that the life of both cutting edges is considerably extended.

Two similar guides 26*a* and 26*b* are provided on opposite sides of the tool body, and each guide is slidable longitudinally between three positions in a guideway formed, in this embodiment, by a series of L-shaped projections 28 extending from the body (see FIG. 1). The three positions for each guide are a central stored portion shown in solid lines when the guide is inoperative, and two opposite extended end positions, shown in broken lines, when it is operative with a different one of the two knife blades. A dimple 30 on the underside of each guide engages in a co-operating slot 32 in the body to determine the end positions, while the top side of each slide is provided with finger engaging anti-slip ribs. In normal use therefore, the guides are hidden away, but are available instantly when required. Each guide in extended end position is spaced the required amount (usually about 0.15 cm.) from the respective knife blade, so that a protruding edge of the sheet material of corresponding width is formed that can be folded around the edge of a door or window opening, or alternatively by use of the other guide the sheet can be recessed the same amount from the wall edge or opening. When stored the two guides can be placed in their end position embracing the triangular knife for safety storage of the tool and to prevent hand etc., contact therewith.

It will be apparent to those skilled in the art that the tool construction specifically illustrated is particularly suited for production by plastic moulding with the body as a unitary structure and the blades and guides fitted therein. Other processes of manufacture can of course be used, and other embodiments of the invention may of course have an appearance in design differing from that of the presently preferred embodiment as illustrated.

I claim:

1. A handtool for the application of sheet material to a surface comprising:

a thin body of obtuse angle triangle shape in side elevation, having an obtuse-angled tip apex opposite to a base side thereof, and having respective base apices opposite to its other two sides, the body being adapted to be grasped adjacent its base side by the hand of an operator;

the tip apex of the body being rounded for folding engagement thereof with the sheet material;

a first circular knife blade rotatably mounted at one of the base apexes with its circular cutting edge aligned with the adjacent other side;

and a second straight-edge knife blade mounted at the other base apex with its straight cutting edge aligned with the adjacent other side;

each of said two other body sides having a straight portion thereof cooperating with the respective knife blade, whereby with the said body side straight portion in contact with the sheet material the respective knife blade cutting edge cuts into the sheet material and is guided by the straight portion in a cut coextensive therewith as the handtool is moved by the operator over the sheet material.

2. A handtool is claimed in claim 1, wherein the said straight edge knife blade is of equilateral triangle shape and is movable and reversible on the body to provide six operative cutting edges.

3. A handtool as claimed in claim 1, wherein the said circular knife blade is toothed with the teeth extending beyond a recessed cutting edge.

4. A handtool as claimed in claim 1, and comprising two guides mounted on opposite sides of the body for sliding movement parallel to the base side, each guide being movable between a retracted stored position wholly within the body profile, and extended positions in which it is alongside a respective one of the knife blades to guide the cutting thereby a fixed distance from a surface engaged by the guide, both guides being movable to embrace the straight-edge knife blade for safety storage of the handtool.

5. A handtool as claimed in claim 1, wherein the body is provided parallel to the base side between the two knife blades with finger-engaging grooves to facilitate the gripping by an operator's hand.

6. A handtool as claimed in claim 1, and comprising two guides mounted on opposite sides of the body for sliding movement parallel to the base side, each guide being movable between a retracted stored position wholly within the body profile, and an extended position in which it is alongside one of the knife blades to guide the cutting thereby a fixed distance from a surface engaged by the guide.

7. A handtool as claimed in claim 6, wherein each guide is slidable in a guide way constituted by a plurality of L-shaped projections from the body of the tool.

* * * * *